US007074366B2

(12) United States Patent
Alam

(10) Patent No.: US 7,074,366 B2
(45) Date of Patent: Jul. 11, 2006

(54) DEVICE AND A METHOD FOR APPLICATION OF LIQUID SOLUTIONS ON MEMBRANES

(76) Inventor: Aftab Alam, 500 Clayton Meadows, St. Louis, MO (US) 63011

( * ) Notice: Subject to any disclaimer, the term of this patent is extended or adjusted under 35 U.S.C. 154(b) by 628 days.

(21) Appl. No.: 09/932,605

(22) Filed: Aug. 17, 2001

(65) Prior Publication Data

US 2002/0023872 A1 Feb. 28, 2002

Related U.S. Application Data

(60) Provisional application No. 60/256,732, filed on Dec. 19, 2000, provisional application No. 60/229,179, filed on Aug. 28, 2000.

(51) Int. Cl.
*B01L 11/00* (2006.01)

(52) U.S. Cl. ..... 422/101; 422/99; 422/100; 210/473; 210/927; 210/650; 210/456; 436/180

(58) Field of Classification Search ..... 435/297.5, 435/305.2; 422/102, 104, 99–101; 436/177, 436/178, 180; 210/473, 456, 927, 650
See application file for complete search history.

(56) References Cited

U.S. PATENT DOCUMENTS

| | | | | |
|---|---|---|---|---|
| 3,390,962 | A * | 7/1968 | Herbert | 422/58 |
| 4,317,726 | A * | 3/1982 | Shepel | 210/236 |
| 4,493,815 | A * | 1/1985 | Fernwood et al. | 422/101 |
| 5,011,779 | A * | 4/1991 | Maimon | 435/309.1 |
| 5,320,811 | A * | 6/1994 | Mount et al. | 422/101 |
| 6,054,325 | A * | 4/2000 | Kedar et al. | 436/178 |
| 6,306,578 | B1 * | 10/2001 | Schellenberger et al. | 435/4 |

* cited by examiner

*Primary Examiner*—Jill Warden
*Assistant Examiner*—Jyoti Nagpaul

(57) ABSTRACT

A device for application of multiple liquid samples on membrane by capillary action and creation of sample arrays.

14 Claims, 8 Drawing Sheets

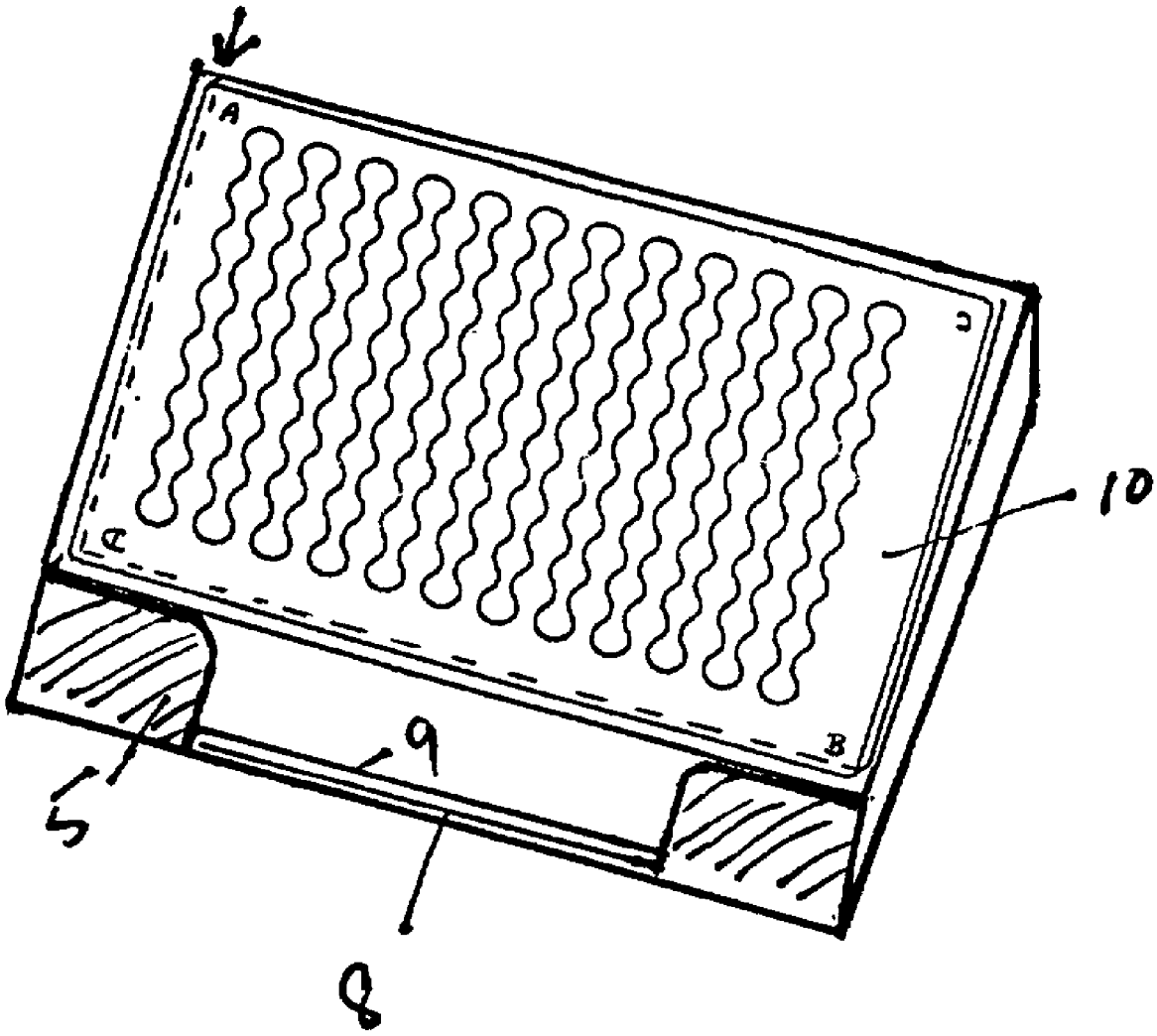
Fig 3.B

DEVICE AND A METHOD FOR APPLICATION OF LIQUID SOLUTIONS ON MEMBRANES

REFERENCE TO RELATED APPLICATIONS

This application claims priority from pending provisional U.S. patent applications Ser. No. 60/229,179 filing date Aug. 28, 2000 and Ser. No. 60/256,732 filing date Dec. 19, 2000.

HISTORY OF THE INVENTION

Dot-Blot sensitivity is significantly reduced if the solution applied to the membrane spreads over a large surface area. Consequently, the samples with low abundance may give false negative results. In many research application it is advantageous to apply sample by capillary action in order to concentrate the sample in a smaller area. There are not many devices currently available for application of multiple samples by capillary action. When processing multiple samples numbering is several hundred, samples are preferably applied on a single membrane in a grid pattern and the resulting membrane containing samples is termed sample array. Devices for making arrays are generally very expensive and complicate to operate. Therefore, there is need for developing a device for making sample arrays that is simple to use and preferably the samples are applied by capillary action.

The present invention relates to a method, a device for application of liquid samples on membrane wherein the sample is applied on the membrane preferably by capillary action. The invention further relates to a method and a device for application of multiple samples on the membrane and creation of sample arrays.

SUMMARY OF THE INVENTION

There is provided a device and a method for application of liquid samples on a membrane. The device is such that it allows application of one or more liquid samples on the membrane, preferably by capillary action.

A device for application of liquid samples on a membrane, comprising:

- a reservoir having an open end and an end opposite the open end having a capillary opening, wherein the open end is adapted to receive liquid samples and/or liquid pipetting devices for aliquoting liquid sample through the capillary opening on the opposite end;
- a frame-means for securing the membrane for application of the liquid sample; and
- a reservoir-rack for positioning the reservoir above the membrane surface such that the capillary opening of the reservoir touches and come in contact with the membrane.

The reservoir open end is connected with the capillary opening with a reservoir-body, wherein the reservoir-body has body circumference or inside diameter wide enough so that when a liquid sample is loaded through the open end the sample may freely migrate (under the force of gravity and without hindrance by surface tension ) down to the capillary opening, i.e., the end opposite the open end. For making such a reservoir, the reservoir-body should have a wide circumference (i.e. internal diameter) which suddenly connect with the capillary opening. Generally a reservoir-body with inside diameter larger than 3–4 mm would allow 1–10 μl liquid samples to freely migrate to the capillary opening. If the reservoir body is narrower it may restrict, due to surface tension, the free migration of small liquid samples, such as 1–10 μl, toward the capillary opening.

The reservoir is either a single reservoir or an assembly of a plurality of individual reservoirs. When there is an assembly of a plurality of individual reservoirs then the reservoirs are spaced from each other such that the open end of the reservoir is compatible with the multi-sample pipetting devices common in the industry. Preferably each individual reservoir is approximately 9 mm apart from the center.

The reservoir-rack is preferably a rectangular shaped plate having one or more through-hole for positioning the reservoir in it. The reservoir may simply be placed in individual through-hole. Preferably, the reservoir-rack allows free up and down movement of the reservoirs. Further, either side or face of the reservoir-rack may be used for positioning the reservoirs. The reservoir-rack may be rotated to 180 degree and/or flipped and placed within the device for use and positioning of the reservoirs.

The assembly of a plurality of the reservoirs in the reservoir-rack is arranged in a grid pattern such that it allows positioning of the reservoirs in columns and rows that meets the application heads of the multi-pipetting devices common in the field and industry, (i.e. multi-channel pipetors).

Preferably each assembly consists of 8 or 12 individual reservoirs. Preferably the reservoir-rack has positions for accommodating at least 96 individual reservoirs or more. Preferably the reservoir-rack is provided with a grid marking for identifying the positions of each reservoir and/or the liquid samples applied on the membrane.

The device assembly is provided with a means (i.e. a frame-means) to secure the membrane for the application of the samples. Further, the device assembly is provided with a base means for positioning the frame-means and a membrane within the frame-means. The reservoir-rack is positioned above the membrane such that when the reservoirs are positioned in the reservoir-rack, the capillary opening of the reservoir contacts or rests on the surface of the membrane. Preferably the device is provided with a non-absorbing surface to be positioned underneath the membrane. Preferably the non-absorbing surface is provided with a soft-surface to crush under pressure, such as a rubber padding.

The capillary opening end of the reservoir is a miro-bore opening, wherein the capillary opening has opening orifice narrow enough to prevent the free flow of the liquid samples out of the reservoir under the force of gravity, and further, the liquid sample only flows out when the capillary opening comes in contact with the surface of the membrane. The capillary opening of the reservoir may be provided with a protruding capillary tip from the reservoir-body. The capillary opening allows flow of the liquid sample from the reservoir into the membrane by capillary action or by applying centrifugal force. The capillary opening may be used for taking aliquots of liquid samples using liquid sampling devices positioned in the open end of the reservoir.

Yet another embedment of the invention comprises a reservoir-rack wherein the reservoir-rack is, preferably, a substantially rectangular shaped plate wherein the positions for the reservoirs are asymmetrically placed such that by rotating (horizontally 180 degree) and/or flipping the reservoir-rack to the opposite side, the positions of the reservoirs or the capillary opening contact on the membrane by the reservoir capillary opening may be changed, providing at least two and a maximum of four alternative points of contact on the membrane below for each reservoir position on the reservoir rack. Thus, the reservoir-rack (and the device) having the potential and the capability to create (closely spaced) one to four points of contact or sample application spots on the membrane below by each reservoir position on the reservoir-rack (and reservoir-capillary opening). The device may be constructed in such way that it matches the footprint of micro-titer plates (an industry standard) and the entire device may be positioned in a centrifuge for spinning the entire device. The device may be constructed of a plastic material or other solid materials.

BRIEF DESCRIPTION OF THE DRAWINGS

The invention is further explained with the help of the following drawings.

PREFERRED EMBODIMENT OF THE INVENTION

Figure 1A:
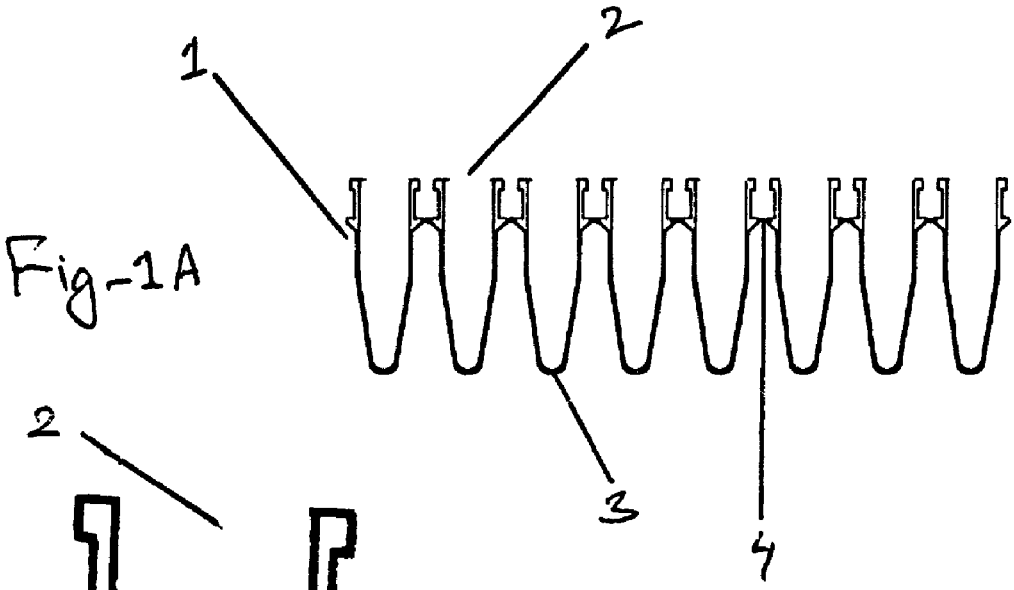
FIG. 1: shows the liquid reservoir, wherein 1B shows an enlarged view of a single reservoir and 1A shows a plurality of the reservoirs assembled as a strip of the tubes or the reservoirs.
Figure 1B:
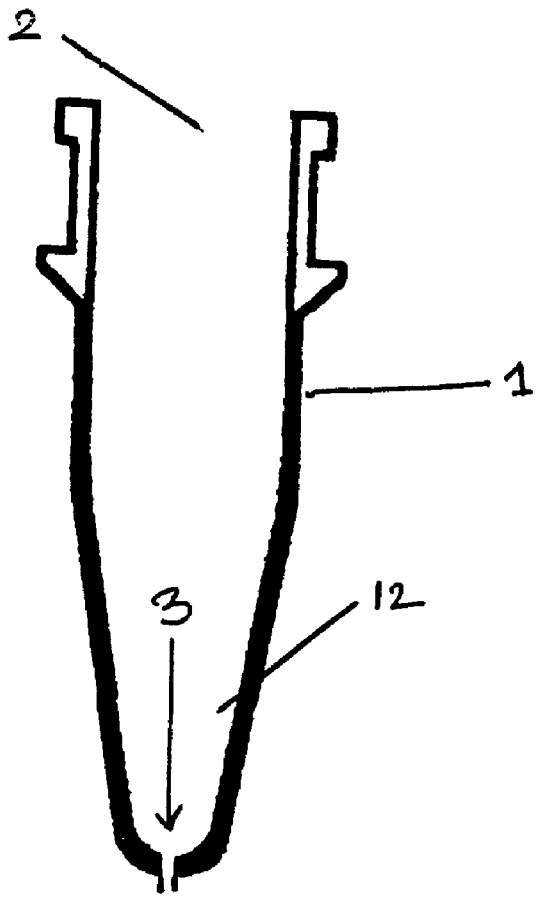

FIG. 1B shows a single reservoir 1, having an open end 2 and the end opposite the open end is a capillary opening 3. The reservoir-body 12 connects the open end 2 to the capillary opening 3. The capillary opening has a slightly protruding capillary tip-end. The reservoir may be made without having a protruding capillary opening or tip-end. The inside diameter of the reservoir-body 12, until it connects with the capillary opening 3, is larger than 3 mm. The FIG. 1A shows multiple reservoir connected together in a row at the rim 4 to form an assembly of the reservoirs.

Figure 2:
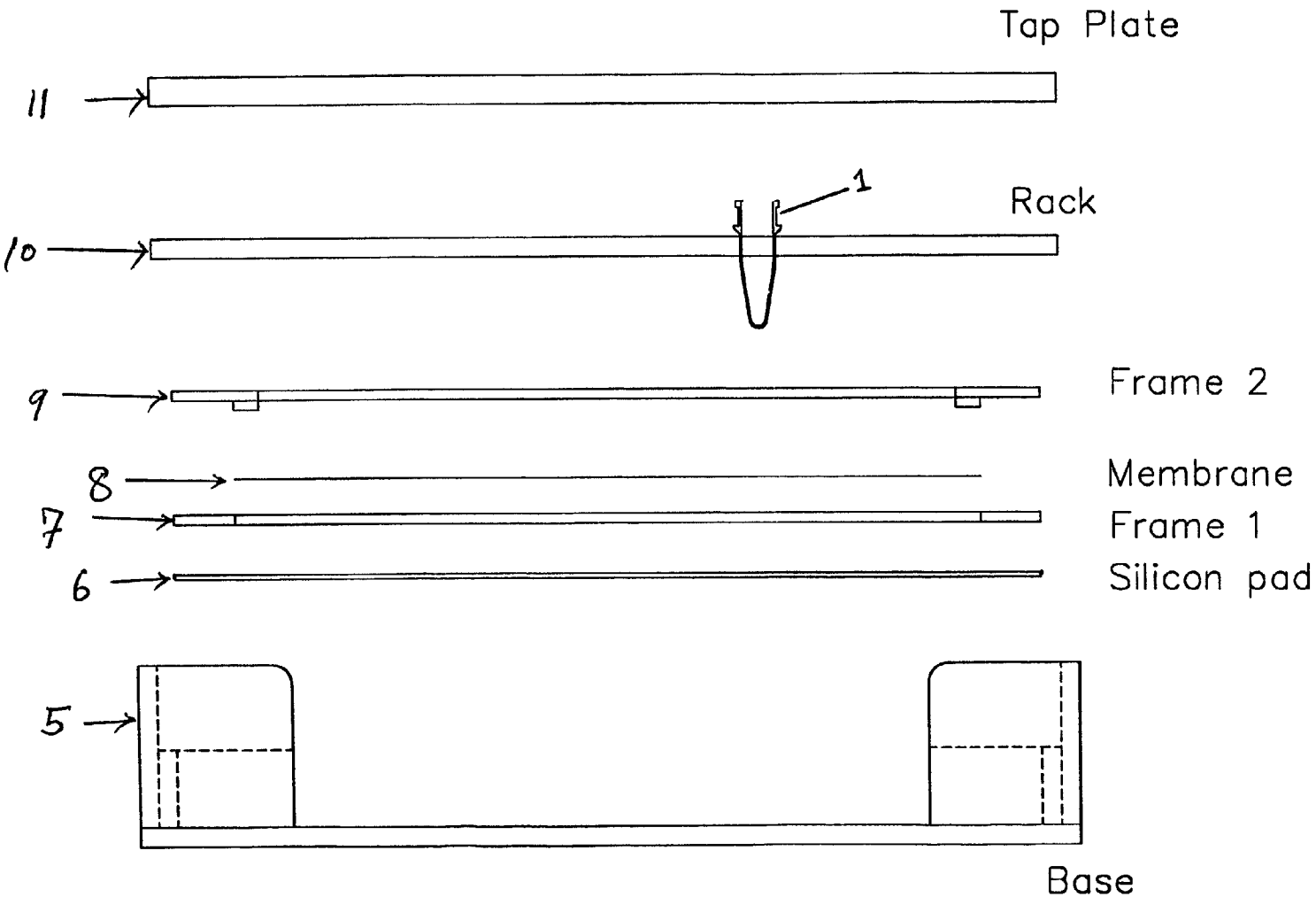
FIG. 2: shows various component elements of the device.
Figure 3A:
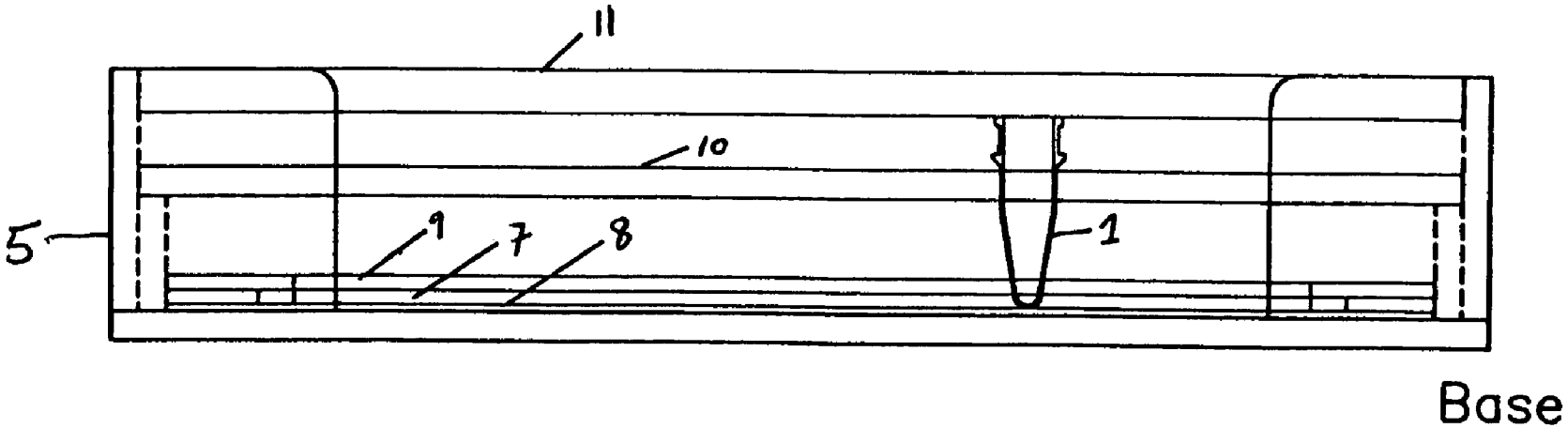
FIG. 3: (A) shows side view of the assembled device of FIG. 2 and (B) shows the top view of the device without a reservoir positioned in the reservoir-rack.

FIG. 2 shows various components of the device wherein 5 is the base of the device for assembly of the various components of the device-the base 5 is a substantially rectangular carriage The sample membrane 8 is secured between a frame-means consisting of the frame 7 and 9. Underneath the membrane 8 a soft non-absorbing padding 6 is placed. The reservoir 1 is positioned on top of the membrane with the help of the reservoir rack 10 and a top plate 11 is placed on top of the assembly to press and secure the reservoir 1 down on top of the membrane 8 and preferably create a fully assembled closed system. In an alternative embodiment, the component base 5 of the device may be made closed from all sides, except the top end is opened for placing the membrane, frames and the reservoir rack. The various components of the device are stacked one on the top of another in the order shown in the drawing FIG. 2. The membrane 8 is sandwich between frame-means 7 and 9. FIG. 3A shows the side view of assembled device of FIG. 2. Whereas FIG. 3B shows top view of the fully assemble device (without a reservoir).

Figure 4:
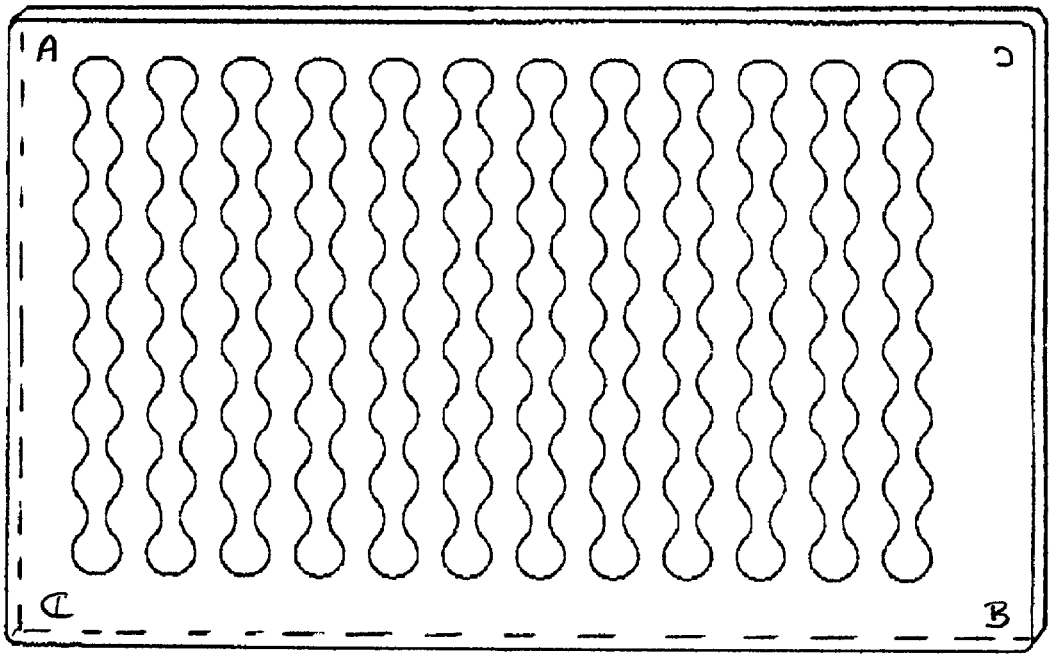
FIG. 4: shows top view of a rectangular reservoir-rack where the set of 96 positions (through-holes) for the reservoirs are asymmetrically placed where each reservoir position is a through-hole.
Figure 5A:
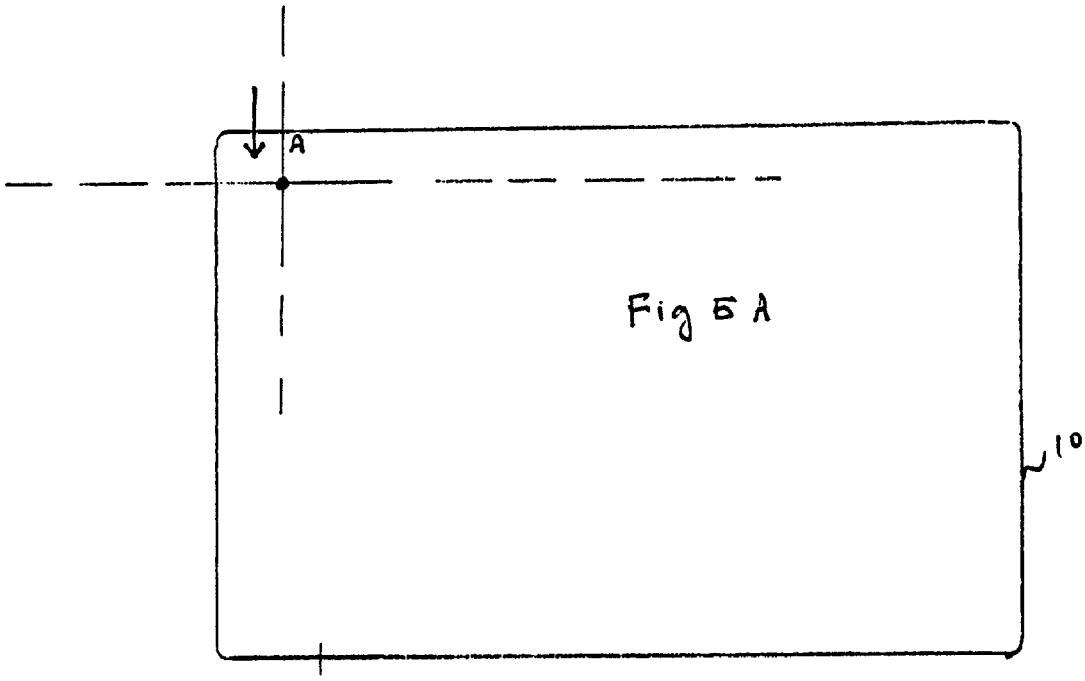
FIG. 5: shows top view of the point of contact on the membrane opposite the rectangular reservoir-rack where the positions for the reservoirs are asymmetrically placed on the reservoir-rack, furthermore, by rotating and flipping the reservoir-rack the foot print of the capillary opening on the membrane below by the reservoirs may be altered, creating 4 alternative closely paced points of contact or foot-print on the membrane for each reservoir.
Figure 5D:
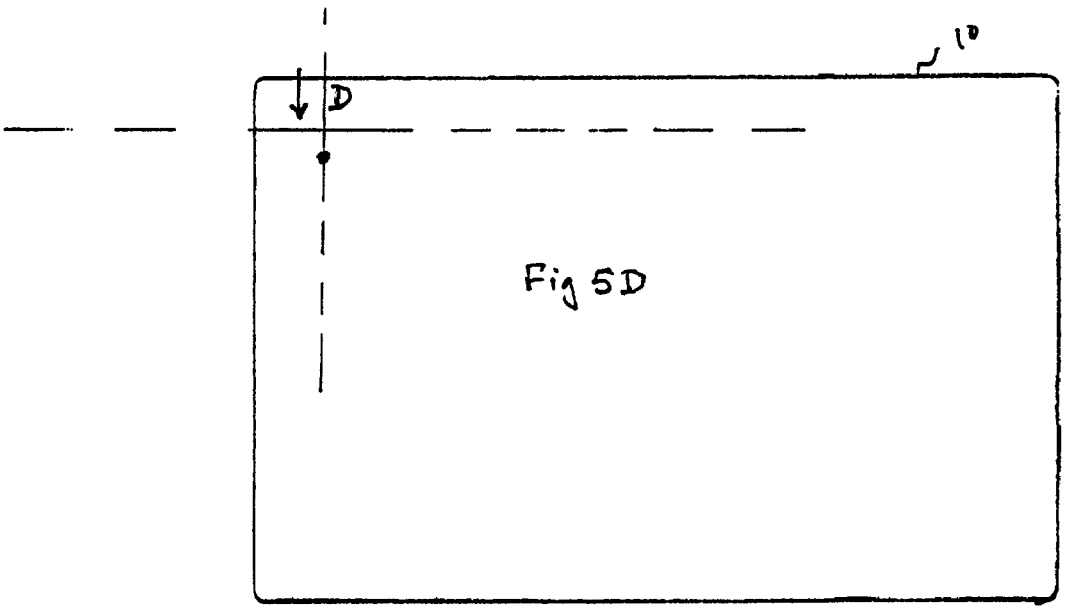
Figure 5C:
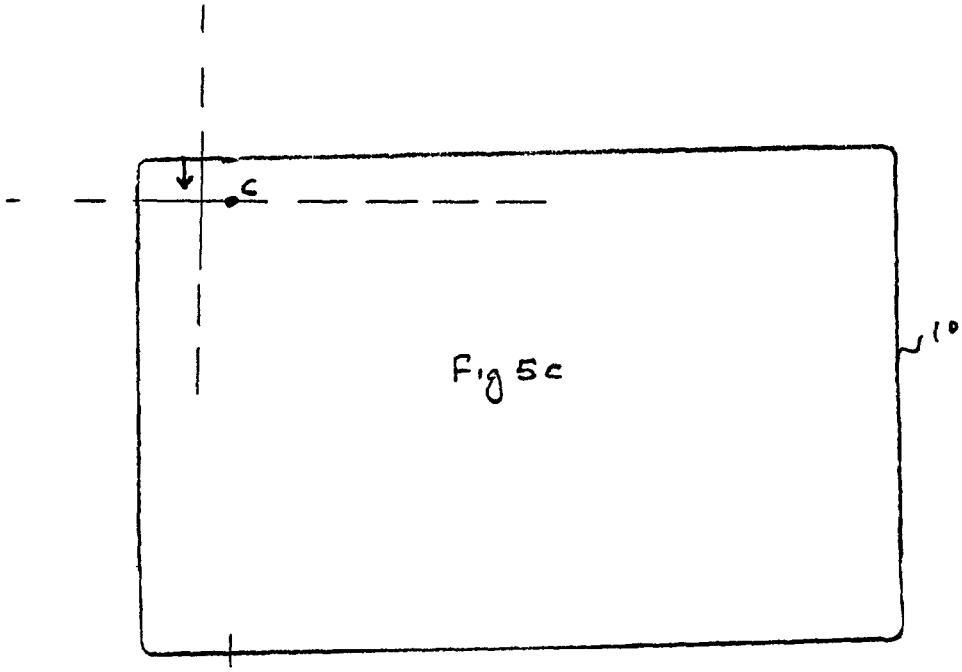
Figure 5B:
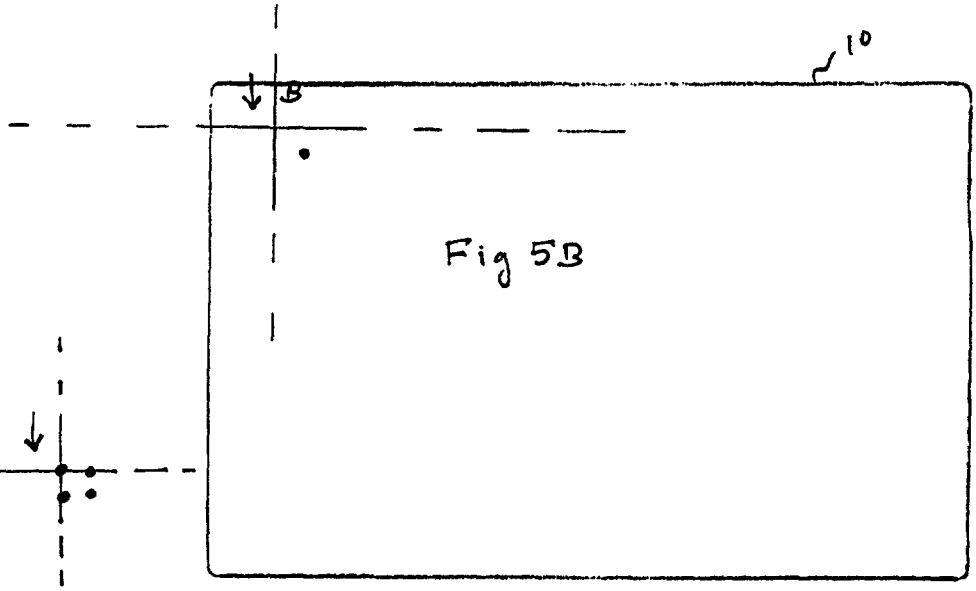
Figure 5E:
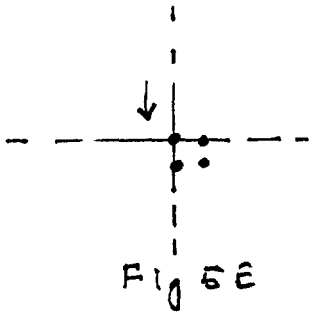
Figure 6:
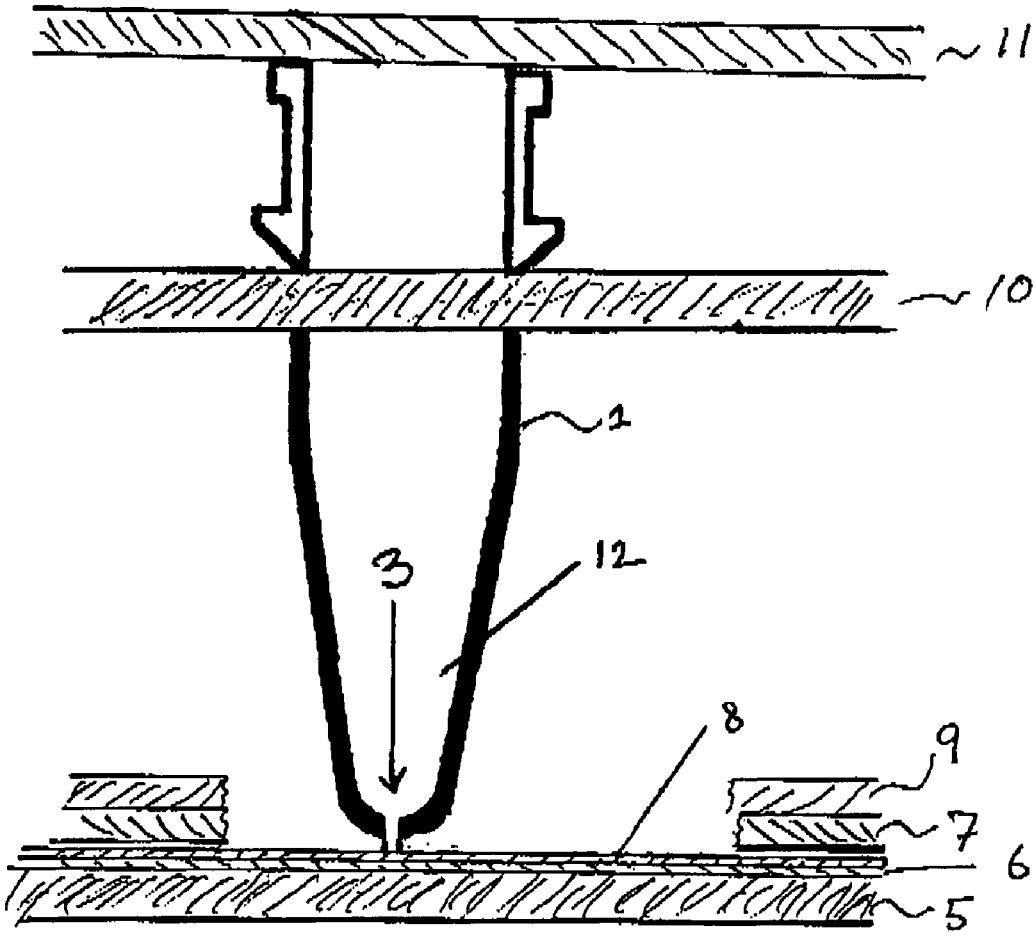
FIG. 6: shows an enlarged partial side view of the assembled device of FIG. 3A.

FIG. 4 shows a substantially rectangular reservoir-rack 10 with asymmetrically located positions for a set of 96 reservoirs. The reservoir-rack is a rectangular plate having 96 through-holes which allow the reservoir to be positioned into the individual hole. The reservoirs simply drop into the through-hole positions in the reservoir-rack and freely hangs from the reservoir, the reservoir may freely move up and down, and rest on the membrane 8 below. A top plate 11 may be placed on top of the reservoir-rack to press the reservoirs down ward. The orientation of the reservoir-rack is marked as A, B, C, & D, where A & B is on one side of the rack and C & D marked on the opposite face of the reservoir rack (for viewing the orientation of the drawing, hold the sheet against a mirror). The reservoir-rack may be positioned in the base 5 of the device FIG. 3B in any orientation. FIG. 5 (A–D) shows foot-prints of a single reservoir capillary opening, when the reservoir is positioned in the reservoir-rack aligning the arrow mark, on the membrane placed opposite the reservoir-rack. The arrow shows a fixed reference point within the base 5 of the device. The broken line shows grid mark on the membrane FIG. 5A shows the foot print of a single reservoir capillary opening on the membrane when the reservoir-rack 10 is placed in the base 5 (as shown in FIG. 3A) such that the mark A corresponds with the reference arrow. FIG. 5B shows the foot print of a single reservoir capillary opening on the membrane when the reservoir-rack 10 is rotated 180 degree (with reference to FIG. 5A) and placed in the base 5 (as shown in FIG. 3B) such that the mark B corresponds with the reference arrow. FIG. 5C shows the foot print of a single reservoir capillary opening on the membrane when the reservoir-rack 10 is flipped (with reference to FIG. 5A) and placed in the base 5 (as shown in FIG. 3C) such that the mark C corresponds with the reference arrow. FIG. 5D shows the foot print of a single reservoir capillary opening on the membrane when the reservoir-rack 10 is flipped (with reference to FIG. 5A) and then placed in the base 5 (as shown in FIG. 3D) such that the mark D corresponds with the reference arrow. FIG. 5E. is a composite image of the foot prints on a single sheet of membrane after four consecutive applications of FIG. 5A to FIG. 5D. If the reservoir-rack is provided with 96 positions. The device will generate a total of 384 distinct reservoir-capillary opening foot-prints (sample spots), wherein each reservoir making 4 foot-prints.

For using the device, the device is assembled as shown in FIG. 2 and FIG. 3, placing membrane 8 between the frame-means 7 and 9. The reservoirs are positioned in the reservoir-rack and liquid samples are introduced into the reservoir. Loading samples into the reservoir may be performed by placing reservoir-rack on a separate platform, after loading the samples, the reservoir-rack containing reservoir and samples may be assembled with the main device, FIG. 3. As the device is assembled, the capillary opening of the reservoirs rest and contact the membrane below. The top plate 11 may also be positioned on top of the reservoir-rack to firmly secured the reservoir on top of the membrane and also cover the sample and the reservoir-rack.

Into each reservoir, a small aliquot of a liquid sample (1–20 μl) is deposited through the open end 2. Since the reservoir-body 12 has wide inside diameter (>3 mm), the sample freely migrates and reachs the capillary opening 3, sometime it may be necessary to gently tap the tops plat 11 or the device to facilitate the migration of the liquid sample to the bottom (capillarity opening) of the reservoir. The opening of the capillary end 3 is so narrow that it prevent free flow of the liquid out of the reservoir. When the capillary end of the reservoir contacts with the surface of the membrane, the liquid sample flows out of the reservoir and diffuse into the surface of the membrane by capillary action. Alternatively, the entire device may be placed in a centrifuge and spun, allowing the sample to migrate through the capillary opening 3 and deposit the sample on the membrane opposite the capillary opening 3. For making multiple dots (sample application), the reservoir-rack may be rotated and/or flipped and reposition in the device. (as in FIG. 5, A to D) The device will be capable of creating, for 96 position reservoir-rack, a total of 4×96=384 spots, i.e. an array of 384 sample spots.

The sample may be loaded into the reservoir by placing a pipetor into the open end 2 of the reservoir and taking an aliquot of the sample through the capillary end 3 of the reservoir. Positioning the reservoir on top of the membrane will allows the sample to diffuse into the membrane by capillary action.

I claim:

1. A device for application of liquid sample on a membrane, comprising a base:

a reservoir having an open end a main body and an end opposite the open end having a capillary opening, wherein the open end is adapted to receive liquid samples;

a frame for securing the membrane for application of the liquid samples, said frame positionable within said base; and a reservoir-rack positionable within said base, said reservoir-rack for positioning said reservoir above the membrane surface such that the capillary opening of the reservoir touches and contacts the membrane, wherein said reservoir-rack has an asymmetrical pattern of positions into which the reservoir can be placed and wherein said reservoir-rack is movable and said base is provided with a means to position the reservoir-rack on said frame by at least two alternative ways producing two alternative footprints and point of contacts on the membrane below for each reservoir position on the reservoir-rack.

2. The device according to claim 1 wherein the device is provided with a plurality of the reservoirs.

3. The device according to claim 1 wherein said reservoir-rack has asymmetrically located through-holes for positioning the reservoir in the reservoir-rack.

4. The device according to claim 1 wherein the reservoir-rack consists of positions for at least 96 individual reservoirs.

5. The device according to claim 4 wherein the reservoirs in said reservoir-rack are arranged in a grid pattern such that it allows positioning of the reservoirs in columns and rows compatible with the application heads of multi-sample pipetting devices.

6. The device according to claim 1 wherein the frame is provided with a means to secure the membrane in the frame-means and position the membrane opposite the reservoir-rack.

7. The device according to claim 1 wherein the capillary opening of the reservoir is a micro-bore opening protruding as a capillary tip from the main body of the reservoir.

8. The device according to claim 1 wherein the capillary opening of the reservoir has an opening orifice narrow enough to prevent the free flow of liquid samples out of the reservoir under the force of gravity.

9. The device according to claim 1 wherein the open end of the reservoir is such that liquid samples may by loaded into the reservoir through the open end.

10. The device according to claim 1 wherein the capillary opening of the reservoir allows flow of the liquid sample from the reservoir into the membrane by capillary action.

11. The device according to claim 1 wherein the capillary opening of the reservoir allow flow of the liquid sample from the reservoir into the membrane by centrifugal action.

12. The device according to claim 1 wherein the capillary opening of the reservoir may be used for taking aliquots of liquid sample using a liquid sampling pipetor placed into the open end.

13. The device according to claim 1 wherein the capillary opening of the reservoir is a micro-bore opening.

14. A device for application of liquid sample on a membrane, comprising: a base; a reservoir having an open end, a main body and an end opposite the open end having a capillary opening, wherein the open end is adapted to receive liquid samples; a frame for securing the membrane for application of the liquid samples, said frame positionable within said base; a reservoir-rack positionable within said base, said reservoir-rack for positioning said reservoir above the membrane surface such that the capillary opening of the reservoir touches and contacts the membrane, wherein said reservoir-rack has an asymmetrical pattern of positions into which the reservoir can be placed and wherein said reservoir-rack is movable and said base is provided with a means to position the reservoir-rack on said frame by at least four alternative ways producing four alternative footprints and point of contacts on the membrane below for each reservoir position on the reservoir-rack.

* * * * *